US011468834B2

(12) United States Patent
Ma et al.

(10) Patent No.: US 11,468,834 B2
(45) Date of Patent: Oct. 11, 2022

(54) PIXEL DRIVING CIRCUIT WITH WIDE RANGE INPUT VOLTAGE

(71) Applicants: Chengdu BOE Optoelectronics Technology Co., Ltd., Sichuan (CN); BOE Technology Group Co., Ltd., Beijing (CN)

(72) Inventors: Yachuan Ma, Beijing (CN); Fucheng Yang, Beijing (CN); Jingang Zhang, Beijing (CN)

(73) Assignees: Chengdu BOE Optoelectronics Technology Co., Ltd., Sichuan (CN); Beijing BOE Technology Development Co., Ltd., Beijing (CN)

( * ) Notice: Subject to any disclaimer, the term of this patent is extended or adjusted under 35 U.S.C. 154(b) by 801 days.

(21) Appl. No.: 16/334,899

(22) PCT Filed: May 18, 2018

(86) PCT No.: PCT/CN2018/087481
§ 371 (c)(1),
(2) Date: Mar. 20, 2019

(87) PCT Pub. No.: WO2019/136898
PCT Pub. Date: Jul. 18, 2019

(65) Prior Publication Data

US 2021/0335230 A1 Oct. 28, 2021

(30) Foreign Application Priority Data

Jan. 10, 2018 (CN) ..... 201810022821.3

(51) Int. Cl.

| | |
|---|---|
| ***G09G 3/30*** | (2006.01) |
| ***G09G 3/3233*** | (2016.01) |
| ***G09G 3/3266*** | (2016.01) |
| ***G09G 3/3291*** | (2016.01) |

(52) U.S. Cl.
CPC ..... *G09G 3/3233* (2013.01); *G09G 3/3266* (2013.01); *G09G 3/3291* (2013.01);
(Continued)

(58) Field of Classification Search
CPC ... G09G 3/14; G09G 3/30–3291; H04L 67/12
See application file for complete search history.

(56) References Cited

U.S. PATENT DOCUMENTS

| | | | | |
|---|---|---|---|---|
| 6,351,078 | B1 | 2/2002 | Wang et al. | |
| 2006/0061525 | A1* | 3/2006 | Kim ..... | G09G 3/3233 345/76 |

(Continued)

FOREIGN PATENT DOCUMENTS

| | | | |
|---|---|---|---|
| CN | 103778889 | A | 5/2014 |
| CN | 106910464 | A | 6/2017 |

(Continued)

OTHER PUBLICATIONS

International Search Report & Written Opinion dated Oct. 15, 2018, regarding PCT/CN2018/087481.

(Continued)

*Primary Examiner* — Sanhyuk Park
(74) *Attorney, Agent, or Firm* — Intellectual Valley Law, P.C.

(57) ABSTRACT

The present application discloses a pixel driving circuit for a sub-pixel in light-emitting display. The pixel driving circuit includes a driving sub-circuit comprising N driving transistors connected in series. N is an integer greater than 1. The N driving transistors include a first driving transistor having a source electrode coupled to a first input voltage port and an N-th driving transistor having a drain electrode coupled to a light-emitting diode. Additionally, the pixel driving circuit includes a power-storage sub-circuit coupled to a gate electrode of the first driving transistor and the drain (Continued)

electrode of the N-th driving transistor. Furthermore, the pixel driving circuit includes a charge-input sub-circuit configured to use a first control signal from a first scan line to control a connection between the gate electrode of the first driving transistor and a data line supplying a data voltage.

20 Claims, 7 Drawing Sheets

(52) U.S. Cl.
CPC ..... *G09G 2300/0861* (2013.01); *G09G 2310/0278* (2013.01)

(56) References Cited

U.S. PATENT DOCUMENTS

2009/0115765 A1 5/2009 Toyomura et al.
2012/0299978 A1 11/2012 Chaji
2015/0108437 A1* 4/2015 Cho ..... H01L 27/3248 257/40
2015/0154906 A1 6/2015 Chung
2017/0140724 A1 5/2017 Lin et al.
2021/0027709 A1 1/2021 Nishiyama
2021/0035500 A1 2/2021 Nishiyama

FOREIGN PATENT DOCUMENTS

CN 107342050 A 11/2017
WO 03037040 A1 5/2003
WO 2019186723 A1 10/2019
WO 2019186725 A1 10/2019

OTHER PUBLICATIONS

Extended European Search Report in the European Patent Application No. 18855147.7, dated Sep. 16, 2021.

* cited by examiner

PIXEL DRIVING CIRCUIT WITH WIDE RANGE INPUT VOLTAGE

CROSS-REFERENCE TO RELATED APPLICATION

This application is a national stage application under 35 U.S.C. § 371 of International Application No. PCT/CN2018/087481, filed May 18, 2018, which claims priority to Chinese Patent Application No. 201810022821.3, filed Jan. 10, 2018, the contents of which are incorporated by reference in the entirety.

TECHNICAL FIELD

The present invention relates to display technology, more particularly, to a pixel driving circuit with wide range input voltage, and a display apparatus having the same.

BACKGROUND

Organic light-emitting diode (OLED) display has been widely applied for micro-display field with many advantages like wide view angle, fast light response, high contrast, and low power consumption. In particular, OLED display has ultra-high resolution with each sub-pixel occupying very small area (no more than a few tens of square micrometers), so does the pixel driving circuit for each sub-pixel, thereby limiting corresponding circuit line width. The subpixel brightness of the OLED display is proportional to a current flowing through the light-emitting diode. The limited circuit line width results in the current being reduced to an order of μA. Accurate control of the current flowing through the light-emitting diode becomes very important to achieve uniform brightness for images on the OLED display.

SUMMARY

In an aspect, the present disclosure provides a pixel driving circuit. The pixel driving circuit includes a driving sub-circuit comprising N driving transistors connected in series. Here N is an integer greater than 1. The N driving transistors include a first driving transistor having a drain electrode coupled to a power-supply port and an N-th driving transistor having a source electrode coupled to a light-emitting diode. Additionally, the pixel driving circuit includes a power-storage sub-circuit coupled to a gate electrode of the first driving transistor and the source electrode of the N-th driving transistor. Moreover, the pixel driving circuit includes a charge-input sub-circuit configured to have the gate electrode of the first driving transistor to receive a data voltage under control of a first control signal at a turn-on voltage level.

Optionally, the N driving transistors connected in series includes an n-th driving transistor and an (n+1)-th driving transistor connected in series. A source electrode of the n-th driving transistor is coupled to both a gate electrode and a drain electrode of the (n+1)-th driving transistor. Here n is a positive integer and (n+1) is smaller than or equal to N. The first control signal is supplied from a first scan line and the data voltage is supplied from a data line.

Optionally, the pixel driving circuit further includes an emission-control sub-circuit configured to connect the source electrode of the N-th driving transistor to the light-emitting diode under control of a second control signal at a turn-on voltage level from a second scan line or to disconnect the source electrode of the N-th driving transistor from the light-emitting diode under control of a second control signal at a turn-off voltage level from a second scan line.

Optionally, the emission-control sub-circuit includes an emission-control transistor including a gate electrode coupled to the second scan line, a drain electrode coupled to the source electrode of the N-th driving transistor, and a source electrode coupled to light-emitting diode.

Optionally, a difference between threshold voltages of any two driving transistors in the N driving transistors has an absolute value substantially same.

Optionally, the N driving transistors are a same type. Optionally, N=3, and n≤2.

Optionally, the charge-input sub-circuit includes a charge-input transistor having a gate electrode coupled to the first scan line, a drain electrode coupled to the data line, and a source electrode coupled to the gate electrode of the first driving transistor.

Optionally, the power-storage sub-circuit includes a capacitor having a first electrode coupled to the gate electrode of the first driving transistor and a second electrode coupled to the source electrode of the N-th driving transistor.

Optionally, the pixel driving circuit further includes a discharge sub-circuit configured to connect the source electrode of the N-th driving transistor to a ground port under control of a third control signal from a third scan line.

Optionally, the discharge sub-circuit includes a discharge transistor having a gate electrode coupled to the third scan line, a drain electrode coupled to the source electrode of the N-th driving transistor, and a source electrode coupled to the ground port.

In another aspect, the present disclosure provides a method of driving a pixel driving circuit described herein in a cycle time for displaying one frame of image, wherein the cycle time comprises sequentially a charging period, a data-inputting period, and an emitting period. In the charging period the method includes writing a reference voltage from a data line to the gate electrode of the first driving transistor by the charge-input sub-circuit under control of the first control signal at a turn-on voltage level from a first scan line, thereby making the N driving transistors connected in series in conduction state. The method further includes charging the power-storage sub-circuit and pulling up a voltage level at a first electrode of a capacitor in the power-storage sub-circuit until the N driving transistors are turned off. In the data-inputting period, the method includes providing a data voltage to the data line. The method further includes writing the data voltage from the data line to the gate electrode of the first driving transistor by the charge-input sub-circuit under control of the first control signal from the first scan line. Additionally, the method includes changing a voltage level at a second electrode of the capacitor in the power-storage sub-circuit by coupling a change from the reference voltage to the data voltage at the first electrode of the capacitor. In the emitting period, the method includes disconnecting the gate electrode of the first driving transistor from the data line by the charge-input sub-circuit under control of the first control signal from the first scan line. The method further includes passing a driving current through the N driving transistors connected in series to drive emission of a light-emitting diode. N is an integer greater than 1.

Optionally, the pixel driving circuit includes an emission-control sub-circuit configured to connect the drain electrode of the N-th driving transistor to the light-emitting diode. Optionally, the method further includes disconnecting the source electrode of the N-th driving transistor from the light-emitting diode by the emission-control sub-circuit under control of a second control signal from a second scan line in the charging period. Additionally, the method includes connecting the source electrode of the N-th driving transistor to the light-emitting diode by the emission-control sub-circuit under control of the second control signal from the second scan line in the data-inputting period. Furthermore, the method includes connecting the source electrode of the N-th driving transistor to the light-emitting diode by the emission-control sub-circuit under control of the second control signal from the second scan line in the emitting period.

Optionally, each of the N driving transistors is an n-type transistor and the data voltage is set to be greater than the reference voltage.

Optionally, each of the N driving transistors is a p-type transistor and the data voltage is set to be smaller than the reference voltage.

Optionally, the pixel driving circuit further includes a discharging sub-circuit configured to use a third control signal from a third scan line to control a connection between the source electrode of the N-th driving transistor and a discharge port. The cycle time further includes a resetting period before the charging period. The method further includes connecting the source electrode of the N-th driving transistor to the discharge port by the discharge sub-circuit under control of the third control signal from the third scan line in the resetting period. Additionally, the method includes providing a reference voltage to the data line. Furthermore, the method includes writing the reference voltage to the gate electrode of the first driving transistor by the charge-input sub-circuit under control of the first control signal from the first scan line, thereby making the N driving transistors connected in series in conduction state, and releasing residue charges in the power-storage sub-circuit to a ground port.

Optionally, the pixel driving circuit further includes a discharging sub-circuit configured to use a third control signal from a third scan line to control a connection between the source electrode of the N-th driving transistor and a discharge port. The cycle time further includes a resetting period before the charging period. The method further includes disconnecting the source electrode of the N-th driving transistor from the light-emitting diode by the emission-control sub-circuit under control of the second control signal from the second scan line in the resetting period. Additionally, the method includes connecting the source electrode of the N-th driving transistor to the discharge port by the discharge sub-circuit under control of the third control signal from the third scan line in the resetting period. Furthermore, the method includes providing a reference voltage to a data line. Moreover, the method includes writing the reference voltage to the gate electrode of the first driving transistor by the charge-input sub-circuit under control of the first control signal from the first scan line, thereby making the N driving transistors connected in series in conduction state and releasing residue charges in the power-storage sub-circuit to a ground port.

Optionally, the method further includes disconnecting the source electrode of the N-th driving transistor from the discharge port by the discharge sub-circuit under control of the third control signal from the third scan line in each of the charging period, the data-inputting period, and the emitting period.

In yet another aspect, the present disclosure provides a pixel circuit including a light-emitting device and a pixel driving circuit described herein. The pixel driving circuit includes a driving sub-circuit having N driving transistors connected in series. A first driving transistor of the N driving transistor is a first transistor in the series and the N-th driving transistor of the N driving transistors is a last transistor in the series. The first driving transistor has a drain electrode coupled to a first input voltage port and the N-th driving transistor has a source electrode coupled to the light-emitting device. N is an integer greater than 1.

Optionally, the N driving transistors connected in series include an n-th driving transistor connected to an (n+1)-th driving transistor. A source electrode of the n-th driving transistor is coupled to both a gate electrode and a drain electrode of the (n+1)-th driving transistor. Here n is a positive integer and (n+1) is smaller than or equal to N.

Optionally, the light-emitting device is an organic light-emitting diode.

In still another aspect, the present disclosure provides a display apparatus comprising a pixel circuit described herein.

BRIEF DESCRIPTION OF THE FIGURES

The following drawings are merely examples for illustrative purposes according to various disclosed embodiments and are not intended to limit the scope of the present invention.

DETAILED DESCRIPTION

The disclosure will now be described more specifically with reference to the following embodiments. It is to be noted that the following descriptions of some embodiments are presented herein for purpose of illustration and description only. It is not intended to be exhaustive or to be limited to the precise form disclosed.

Figure 1:
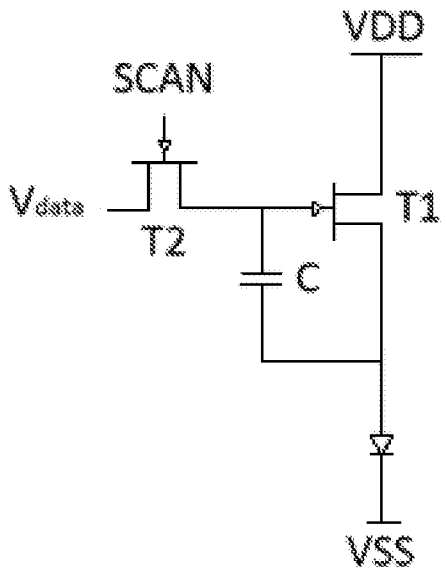
FIG. 1 (related art)
FIG. 1 is a circuit diagram of a conventional 2T1C pixel driving circuit.

FIG. 1 shows a circuit diagram of a conventional 2T1C pixel driving circuit, including a driving transistor T1, a data-input transistor T2, and a storage capacitor C. Referring to FIG. 1, SCAN is a scan line for providing a control signal. OLED is an organic light-emitting diode. VDD is a high voltage supplied from the power-supply port. VSS is a low voltage supplied from another power-supply port. $V_{data}$ is a data voltage supplied to a data line. During its operation, the 2T1C pixel driving circuit provides a current $I_{oled}$ flowing through OLED which can be expressed as:

$$I_{oled} = \frac{W}{L} I_0 \exp\left(\frac{V_{data} - V_{th}}{nV_T}\right) \quad (1)$$

where W/L is a ratio of length to width of the driving transistor; $I_0$ is a leakage current of the driving transistor; n is a sub-threshold slope factor; $V_T$ is a thermo-voltage of the driving transistor; and $V_{th}$ is a threshold voltage of the driving transistor. As seen from the formula, the current flowing through the OLED from the driving transistor is sensitive to the inputting data voltage $V_{data}$ and the threshold voltage $V_{th}$. In order to ensure uniformity of images displayed on the OLED display, the threshold voltage $V_{th}$ of different driving transistor in different pixel driving circuit associated with different sub-pixel must be kept highly consistent. However, manufacture variation of the driving transistors leads to the variation of the threshold voltages. $V_{th}$ consistency requirement posts a huge challenge to the manufacture process of the driving transistor. Because the data voltage inputted to each pixel driving circuit has very little adjustment room, it is hard to adjust $V_{data}$ for compensating the variation of $V_{th}$ and achieving accurate control of the current flowing through the OLED.

Accordingly, the present disclosure provides, inter alia, a pixel driving circuit with wide range input voltage, a pixel driving method, a pixel circuit, and a display apparatus having the same that substantially obviate one or more of the problems due to limitations and disadvantages of the related art. In one aspect, the present disclosure provides a pixel driving circuit used for driving light emission of a light-emitting device.

Figure 2A:
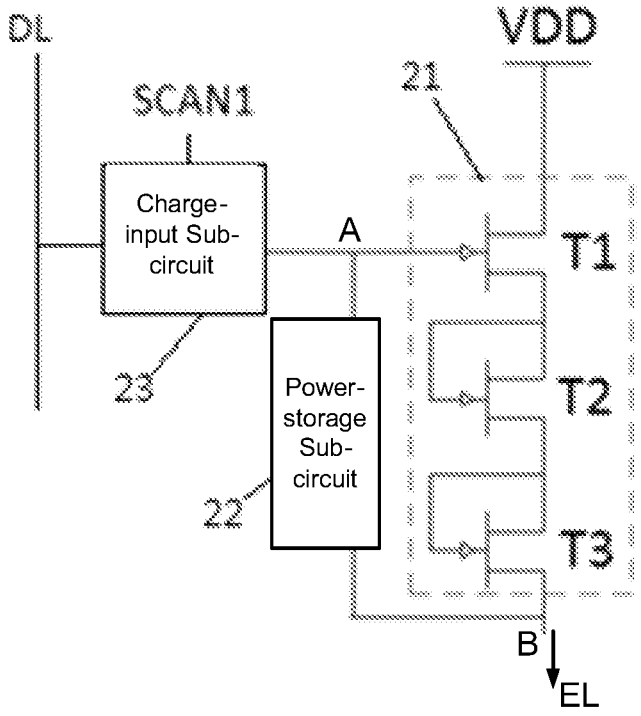
FIG. 2A is a circuit diagram of a pixel driving circuit according to an embodiment of the present disclosure.

Referring to FIG. 2A, the pixel driving circuit is configured to drive a light-emitting device (not shown) to emit light for imaging. The pixel driving circuit includes a driving sub-circuit 21 to be coupled to the light-emitting device EL and a power-supply port VDD, a charge-input sub-circuit 23 coupled to a data line DL, a first scan line SCAN1, and the driving sub-circuit 21 including multiple driving transistors connected in series between a power supply port and the light-emitting device EL, and a power-storage sub-circuit 22 connected between the charge-input sub-circuit 23 and the light-emitting device EL.

Referring to FIG. 2A again, the driving sub-circuit 21 includes N driving transistors connected in series, where N is an integer greater than 1. A first transistor in the series is a first driving transistor T1 of the N driving transistors and a last transistor in the series is an N-th driving transistor of the N driving transistors. In an example, N=3, the third driving transistor T3 is the last transistor in the series. The first driving transistor includes a drain electrode coupled to the power-supply port, which is optionally provided with a high voltage VDD. The N-th driving transistor includes a source electrode coupled to the light-emitting device EL. Optionally, the drain electrode or the source electrode of any of the N driving transistors are merely named for convenience but not based on distinct functionality. The drain electrode can be called a source electrode while the source electrode can be called a drain electrode without affecting the function of the circuit disclosed herein. In general, the N driving transistors connected in series includes an n-th driving transistor connected to an (n+1)-th driving transistor such that a source electrode of the n-th driving transistor is connected to both a gate electrode and a drain electrode of the (n+1)-th driving transistor. Here n is a positive integer and n+1 is smaller than or equal to N. Optionally, N is at least 2. While using at least two driving transistors in the driving sub-circuit 21, an allowable range of data voltage inputted from the data line DL can be expanded comparing to a single driving transistor under a condition that variation range of a driving current for light emission is controlled to be the same for both situations. This certainly can lead to more accurate control for the driving current. Optionally, during the operation of the pixel driving circuit, a threshold voltage difference for any two driving transistors in the series can be set to have an absolute value smaller than a first threshold. This option ensures that all driving transistors in the series can be set to conduction state at a same time during each cycle time for displaying a frame of image. Optionally, all driving transistors in the series are selected to have a same threshold voltage.

Optionally, N=3, as shown in FIG. 2A, three driving transistors includes a first driving transistor T1, a second driving transistor T2, and a third driving transistor T3. T1 has a drain electrode coupled to the power-supply port receiving a high voltage VDD. T3 has a source electrode to be coupled to the light-emitting device EL. Optionally, the light-emitting device EL is a light-emitting diode per sub-pixel being driven by the pixel driving circuit to emit light. T1 also has a source electrode coupled to a gate electrode and a drain electrode of T2. T2 also has a source electrode coupled to a gate electrode and a drain electrode of T3. T1 has a gate electrode coupled to the charge-input sub-circuit 23.

Referring to FIG. 2A, the power-storage sub-circuit 22 has a first electrode coupled to a gate electrode of the first driving transistor T1 and a second electrode coupled to a source electrode of the third driving transistor T3. Further, the charge-input sub-circuit 23 has a control terminal connected to the first scan line SCAN1. The charge-input sub-circuit 23 is configured to connect/disconnect the gate electrode of the first driving transistor T1 to/from a data line DL under control of a first control signal from a first scan line SCAN1. Optionally, each of T1, T2, and T3 can be an n-type transistor. Optionally, each of T1, T2, and T3 can be a p-type transistor. In fact, the pixel driving circuit as shown in FIG. 3 can be operational with all T1, T2, and T3 being the same type of transistor.

Figure 2B:
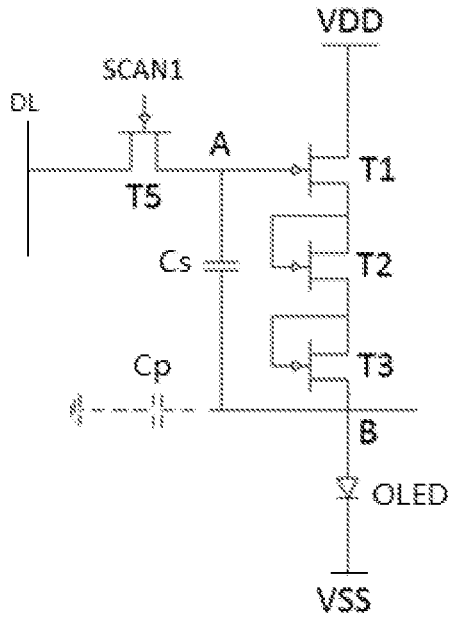
FIG. 2B is a circuit diagram of a pixel driving circuit according to another embodiment of the present disclosure.

FIG. 2B is a circuit diagram of a pixel driving circuit according to another embodiment of the present disclosure. Referring to FIG. 2B, the power-storage sub-circuit 22 includes a storage capacitor Cs. The charge-input sub-circuit 23 includes a charge-input transistor T5. The light-emitting device EL includes an organic light-emitting diode OLED. The storage capacitor Cs has a first terminal A coupled to the gate electrode of the first driving transistor T1 and a second terminal B coupled to the source electrode of the third driving transistor T3. The charge-input transistor T5 has a gate electrode coupled to the first scan line SCAN1, a drain electrode coupled to the data line DL, and a source electrode coupled to the gate electrode of the first driving transistor T1. The OLED has an anode coupled to the source of the third driving transistor T3 and a cathode coupled to another power-supply port supplying a low voltage VSS. Optionally, a parasitic capacitance Cp associated with the second terminal B is depicted in dashed line.

Figure 2C:
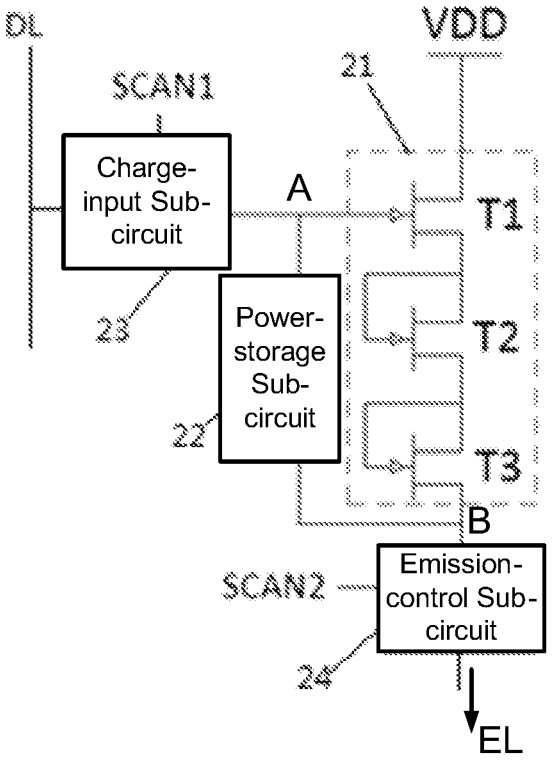
FIG. 2C is a circuit diagram of a pixel driving circuit according to yet another embodiment of the present disclosure.

FIG. 2C is a circuit diagram of a pixel driving circuit according to yet another embodiment of the present disclosure. Referring to FIG. 2C, the pixel driving circuit is substantially based on the pixel driving circuit of FIG. 2A and further includes an emission-control sub-circuit 24 coupled to the driving sub-circuit 21 for controlling light emission of the light-emitting device EL (FIG. 2B). The emission-control sub-circuit 24 has a first terminal coupled to the source of the third driving transistor T3. The emission-control sub-circuit 24 has a second terminal to be coupled to the light-emitting device EL. The emission-control sub-circuit 24 has a control terminal coupled to a second scan line SCAN2 configured to provide a second control signal. The emission-control sub-circuit 24 is configured to connect/disconnect the source electrode of the third driving transistor T3 to/from the light-emitting device EL under control of the second control signal from the second scan line SCAN2.

Figure 2D:
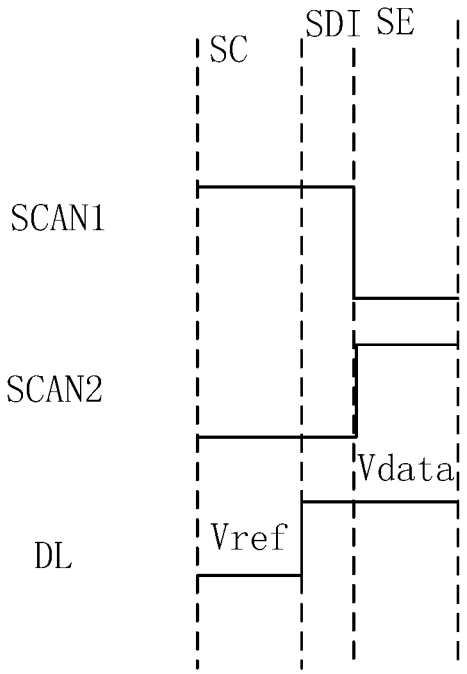
FIG. 2D is a timing diagram of operating the pixel driving circuit of FIG. 2C in one cycle time according to the embodiment of the present disclosure.

FIG. 2D is a timing diagram of operating the pixel driving circuit of FIG. 2C in one cycle time according to the embodiment of the present disclosure. The cycle time is a period for driving a light-emitting diode associated with a sub-pixel to emit light for displaying a frame of image. Optionally, the cycle time includes a charging period SC, a data-inputting period SDI, and an emitting period SE. In the charging period SC, the first control signal outputted from the first scan line SCAN1 is a high-voltage signal. Under the high-voltage signal, the charge-input transistor T5 is turned on. The data line DL outputs a reference voltage $V_{ref}$ (optionally, $V_{ref}$ is set to be slightly larger than $3V_{th}$ assuming that each of the three driving transistors to have a same threshold voltage $V_{th}$). In the data-inputting period SDI, the first control signal further outputs a high-voltage signal to turn on T5. The data line DL outputs a data voltage $V_{data}$. Now a voltage level at the node A (or the first terminal A of the power-storage sub-circuit 22) is written to $V_{data}$. Thus, the storage capacitor Cs is charged to $3V_{th}+\alpha(V_{data}-V_{ref})$, where $\alpha=Cp/(Cp+Cs)$. Further in the emitting period SE, the first control signal outputted from the first scan line SCAN1 is a low-voltage signal, now T5 is turned off. While all driving transistors T1, T2, and T3 are all in conduction state to produce a driving current flowing through the light-emitting device. In particular, the current flowing through an organic light-emitting diode OLED under the pixel driving circuit of FIG. 2B can be expressed as:

$$I_{oled} = \frac{W}{L} I_0 \exp\left(\frac{\alpha(V_{data} - V_{ref})}{3nV_T}\right) \quad (2)$$

Comparing to formula (1) for the conventional 2T1C pixel driving circuit, the formula (2) based on the pixel driving circuit of FIG. 2B does not have a term of the threshold voltage $V_{th}$ of the driving transistor(s). Therefore, the sensitivity of the current to the threshold voltage variation is reduced.

Referring to FIG. 2D again, during the charging period SC, the second control signal from the second scan line SCAN2 is a low-voltage signal. Under control of the second control signal, the emission-control sub-circuit 24 disconnects the source electrode of the third driving transistor T3 from the light-emitting device EL (see FIG. 2B). The data line DL this time outputs the reference voltage $V_{ref}$ and the first scan line SCAN1 outputs the first control signal as a high-voltage signal. Under control of the first control signal from SCAN1, the charge-input sub-circuit 23 writes the reference voltage $V_{ref}$ from the data line DL to the gate electrode of the first driving transistor T1, thereby making each of the first driving transistor T1, the second driving transistor T2, and the third driving transistor T3 in conduction state at the same time. Optionally, $V_{ref}$ is selected to be larger than a sum of threshold voltages of the N driving transistors. Now the first terminal A of the power-storage sub-circuit 22 is charged to pull up a voltage level at the second terminal B (see FIG. 2B) until all of the first driving transistor T1, the second driving transistor T2, and the third driving transistor T3 are turned off.

Further during the data-inputting period SDI, the second control signal outputted from the second scan line SCAN2 is a low-voltage signal. Under control of the second control signal, the emission-control sub-circuit 24 disconnects the source electrode of the third driving transistor T3 from the light-emitting device EL. Now, the data line DL outputs a data voltage $V_{data}$ and the first scan line SCAN1 outputs the first control signal as a high-voltage signal. Optionally, the data voltage $V_{data}$ is greater than the reference voltage $V_{ref}$ (assuming all driving transistors are n-type transistors). Under control of the first control signal, the charge-input sub-circuit 23 writes the data voltage $V_{data}$ to the gate electrode of the first driving transistor T1. This changes the voltage level at the first terminal A of the power-storage sub-circuit 22. The coupling effect of the storage capacitor Cs also induces a voltage change at the second terminal B.

Furthermore, during the emitting period SE, under control of the first control signal as a low-voltage signal, the charge-input sub-circuit 23 disconnects the data line DL from the gate electrode of the first driving transistor T1. The second scan line SCAN2 now outputs the second control signal as a high-voltage signal. Under control of the second control signal, the emission-control sub-circuit 24 connects the source electrode of the third driving transistor T3 to the light-emitting device EL. Since $V_{data}$ is greater than $V_{ref}$, all of the first driving transistor T1, the second driving transistor T2, and the third driving transistor T3 are in conduction state during the emitting period to provide a driving current to drive light emission of the light-emitting device EL. Optionally, the $V_{data}$ can be set to be smaller than $V_{ref}$ if all the driving transistors are p-type transistors and are in conduction state during the emitting period to provide a driving current flowing through the light-emitting device EL to drive light emission thereof.

Optionally during the operation of the pixel driving circuit, the data-inputting period SDI is relatively short so that the emitting period SE is triggered right after the voltage change between two terminals of the power-storage sub-circuit 22. This allows the voltage difference across the two terminals of the power-storage sub-circuit 22 to be able to compensate the threshold voltage(s) of the driving transistor(s).

Figure 3A:
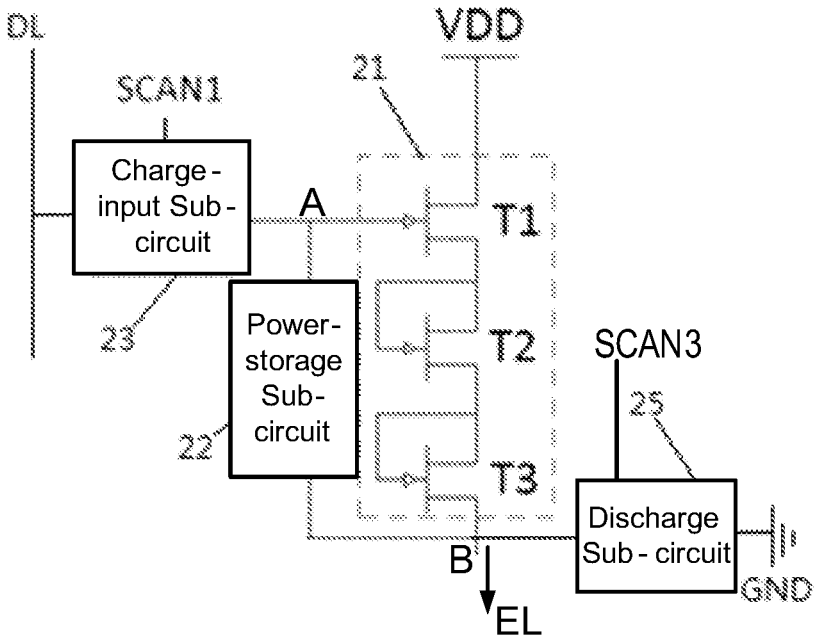
FIG. 3A is a circuit diagram of a pixel driving circuit according to still another embodiment of the present disclosure.

FIG. 3A is a circuit diagram of a pixel driving circuit according to still another embodiment of the present disclosure. Referring to FIG. 3A, the pixel driving circuit includes a driving sub-circuit 21 coupled to a light-emitting device (such as a light-emitting diode in FIG. 2B) and a power-supply port VDD, a charge-input sub-circuit 23 coupled to a data line DL, a first scan line SCAN1. The driving sub-circuit 21 includes multiple driving transistors connected in series between a power supply port and the light-emitting device. The pixel driving circuit further includes a power-storage sub-circuit 22 connected between the charge-input sub-circuit 23 and the light-emitting device EL. Additionally, the pixel driving circuit includes a discharge sub-circuit 25 coupled between the driving sub-circuit 21 and a ground port GND. In particular, the discharge sub-circuit 25 has a first terminal coupled to the source electrode of the third driving transistor T3, a second terminal coupled to the ground port GND, and a control terminal coupled to a third scan line SCAN3 that is configured to supply a third control signal. The discharge sub-circuit 25 is configured to connect or disconnect the source electrode of the N-th (N=3) driving transistor to or from the ground port GND under control of the third control signal from the third scan line SCAN3.

Figure 3B:
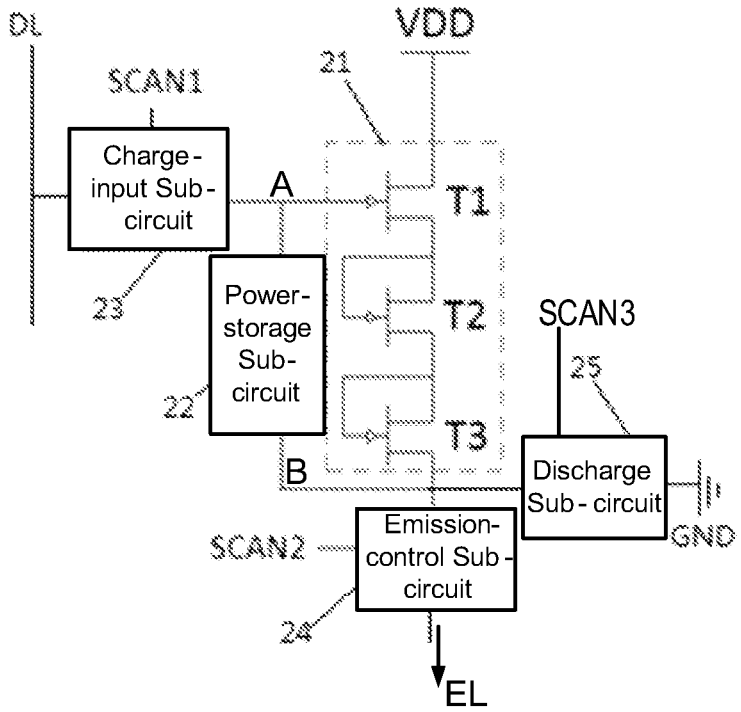
FIG. 3B is a circuit diagram of a pixel driving circuit according to yet still another embodiment of the present disclosure.

FIG. 3B is a circuit diagram of a pixel driving circuit according to yet still another embodiment of the present disclosure. Referring to FIG. 3B, the pixel driving circuit includes a driving sub-circuit 21 coupled to a light-emitting device (such as a light-emitting diode in FIG. 2B) and a power-supply port VDD, a charge-input sub-circuit 23 coupled to a data line DL, a first scan line SCAN1. The driving sub-circuit 21 includes multiple driving transistors connected in series between a power supply port and the light-emitting device EL. Additionally, the pixel driving circuit includes an emission-control sub-circuit 24 coupled to the driving sub-circuit 21 for controlling a current flowing through the light-emitting device EL (FIG. 2B) for emitting light. The emission-control sub-circuit 24 has a first terminal coupled to the source of the third driving transistor T3. The emission-control sub-circuit 24 has a second terminal to be coupled to the light-emitting device EL. The emission-control sub-circuit 24 has a control terminal coupled to a second scan line SCAN2 configured to provide a second control signal. The emission-control sub-circuit 24 is configured to connect/disconnect the source electrode of the third driving transistor T3 to/from the light-emitting device EL under control of the second control signal from the second scan line SCAN2. Furthermore, the pixel driving circuit includes a discharge sub-circuit 25 coupled between the driving sub-circuit 21 and a ground port GND. In particular, the discharge sub-circuit 25 has a first terminal coupled to the source electrode of the third driving transistor T3, a second terminal coupled to the ground port GND, and a control terminal coupled to a third scan line SCAN3 that is configured to supply a third control signal. The discharge sub-circuit 25 is configured to connect or disconnect the source electrode of the N-th (N=3) driving transistor to or from the ground port GND under control of the third control signal from the third scan line SCAN3.

Figure 3C:
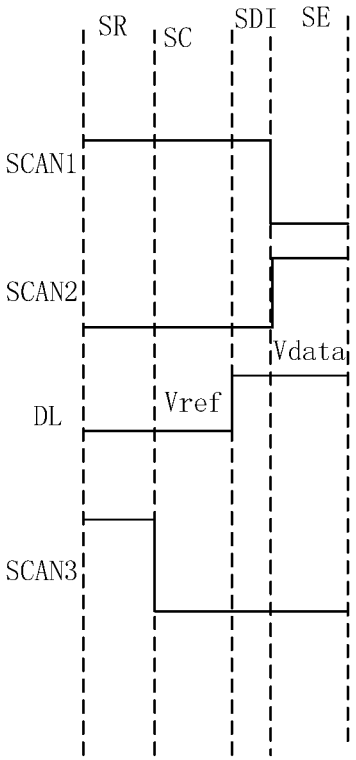
FIG. 3C is a timing diagram of operating the pixel driving circuit of FIG. 3B in one cycle time according to the embodiment of the present disclosure.

FIG. 3C is a timing diagram of operating the pixel driving circuit of FIG. 3B in one cycle time according to the embodiment of the present disclosure. Referring to FIG. 3C, the cycle time of displaying one frame of image also includes a resetting period SR before the charging period SC. During the resetting period, the second scan line SCAN2 outputs the second control signal as a low-voltage signal. Under control of the second control signal, the emission-control sub-circuit 24 disconnects the source electrode of the third driving transistor T3 from the light-emitting device EL. The third scan line SCAN3 outputs the third control signal as a high-voltage signal. Under control of the third control signal, the discharge sub-circuit 25 connects the source electrode of the third driving transistor T3 to the ground port GND. In this period, the data line DL outputs a reference voltage $V_{ref}$ and the first scan line SCAN1 outputs the first control signal as a high-voltage signal. Under control of the first control signal, the charge-input sub-circuit 23 writes the reference voltage from the data line DL to the gate electrode of the first driving transistor T1, thereby making all the driving transistors T1, T2, and T3 in conduction state and allowing the residue charges in the power-storage sub-circuit 22 to be released to the ground port GND. In other words, the resetting period is for releasing residue charges in the power-storage sub-circuit 22.

Referring to FIG. 3C, the cycle time includes a charging period SC, a data-inputting period SDI, and an emitting period SE. In the charging period SC, the third scan line SCAN3 outputs a low-voltage signal. In the data-inputting period SDI, the third scan line SCAN3 outputs a low-voltage signal. In the emitting period SE, the third scan line SCAN3 outputs a low-voltage signal. In other words, during those periods, the discharge sub-circuit 25 is controlled to disconnect the source electrode of the third driving transistor T3 from the ground port GND.

Figure 4A:
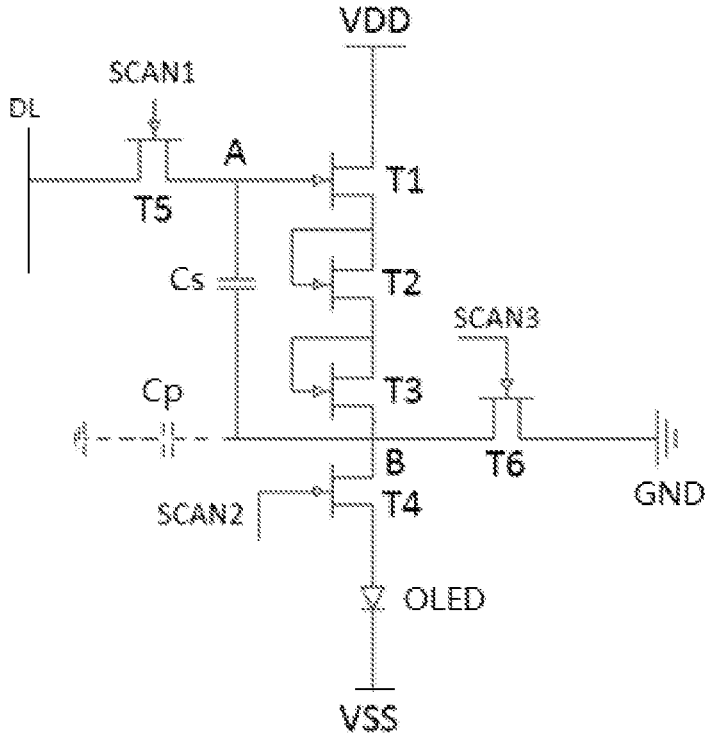
FIG. 4A is a circuit diagram of a pixel driving circuit according to yet still another embodiment of the present disclosure.

FIG. 4A is a circuit diagram of a pixel driving circuit according to yet still another embodiment of the present disclosure. Referring to FIG. 4A, the pixel driving circuit includes a 6T1C structure with all the described sub-circuits including the driving sub-circuit, the charge-input sub-circuit, the power-storage sub-circuit, the emission-control sub-circuit, and the discharge sub-circuit. In particular, the driving sub-circuit includes a first driving transistor T1, a second driving transistor T2, and a third driving transistor T3 connected in series. The power-storage sub-circuit includes a storage capacitor Cs. The emission-control sub-circuit includes an emission-control transistor T4. The charge-input sub-circuit includes a charge-input transistor T5, and the discharge sub-circuit includes a discharge transistor T6. The light-emitting device associated with the pixel driving circuit is an organic light-emitting diode OLED.

Referring to FIG. 4A, the first driving transistor T1 has a drain electrode coupled to a high-voltage port providing a high voltage VDD. The first driving transistor T1 also has a source electrode coupled to a gate electrode and a drain electrode of the second driving transistor T2. The second driving transistor T2 also has a source electrode coupled to a gate electrode and a drain electrode of the third driving transistor T3. The storage capacitor Cs has a first terminal coupled to the gate electrode of the first driving transistor T1 and a second terminal coupled to the source electrode of the third driving transistor T3. The charge-input transistor T5 has a gate electrode coupled to the first scan line SCAN1, a drain electrode coupled to the data line DL, and a source electrode coupled to the gate electrode of the first driving transistor T1. The emission-control transistor T4 has a gate electrode coupled to the second scan line SCAN2, a drain electrode coupled to the source electrode of the third driving transistor T3, and a source electrode coupled to an anode of the OLED. The cathode of the OLED is coupled to a low-voltage port providing a low voltage VSS. Additionally, the discharge transistor T6 has a gate electrode coupled to the third scan line SCAN3, a drain electrode coupled to the source electrode of the third driving transistor T3, and a source electrode coupled to the ground port GND. Furthermore, the node A is connected to the gate electrode of the first driving transistor T1 and the node B is connected to the source electrode of the third driving transistor T3. Cp refers to a parasitic capacitance associated with the node B.

Referring to FIG. 4A again, all the transistors T1, T2, T3, T4, T5, and T6 are N type metal-oxide-semiconductor (NMOS) transistors. Optionally in alternative operation, all the transistors can be P type metal-oxide-semiconductor (PMOS) transistors.

Figure 4B:
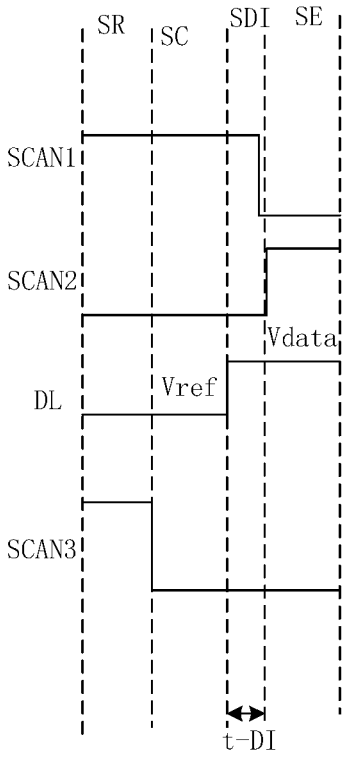
FIG. 4B is a timing diagram of operating the pixel driving circuit of FIG. 4A in one cycle time according to the embodiment of the present disclosure.

FIG. 4B is a timing diagram of operating the pixel driving circuit of FIG. 4A in one cycle time according to the embodiment of the present disclosure. Referring to FIG. 4B, the cycle time for displaying one frame of image includes a resetting period SR, a charging period SC, a data-inputting period SDI, and an emitting period SE.

Figure 5A:
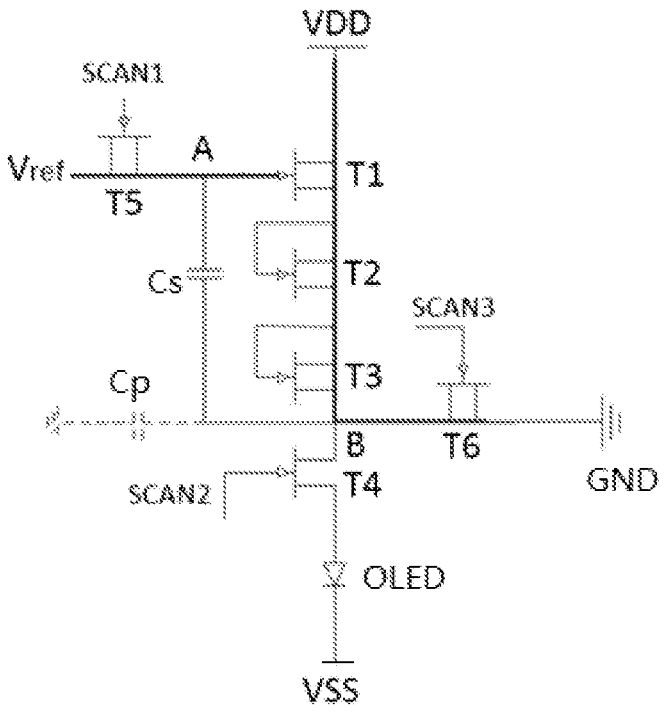
FIG. 5A is a state diagram of operating the pixel driving circuit of FIG. 4A in a resetting period according to the embodiment of the present disclosure.

In the charging period SC, the first scan line SCAN1 provides a high-voltage signal while the second scan line SCAN2 and the third scan line SCAN3 provide low-voltage signals. The pixel driving circuit operated in this period is in a state shown in FIG. 5A. The data line DL provides a reference voltage $V_{ref}$. Transistors T1, T2, T3, T5, and T6 are all in conduction state. T6 in conduction state leads to release of charges stored in the storage capacitor Cs. T4 is turned off so that no current is flowing through the OLED, thereby ensuring low brightness associated with a gray-scale value of 0. Thus, black state of an image is set for a lowest gray-scale brightness to ensure a highest contrast.

Figure 5B:
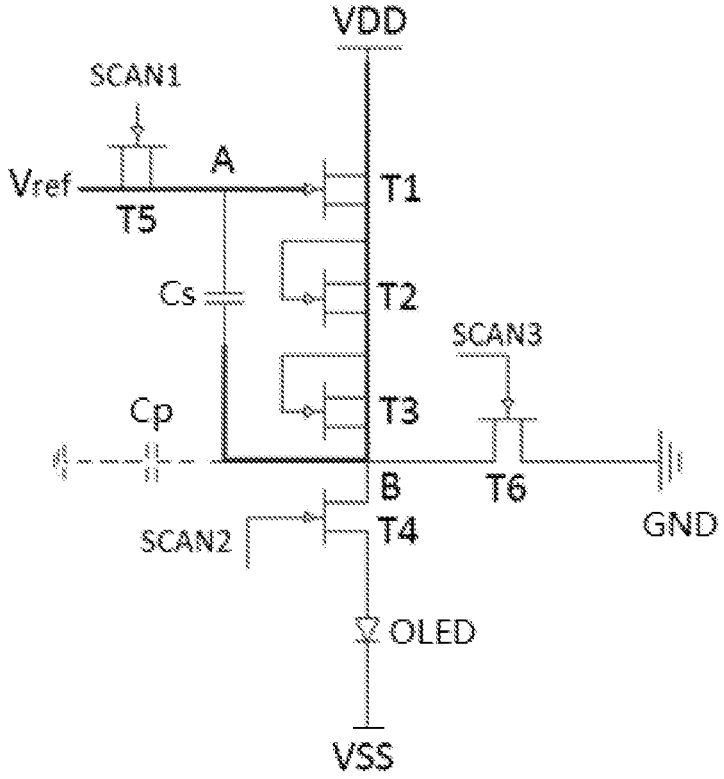
FIG. 5B is a state diagram of operating the pixel driving circuit of FIG. 4A in a charging period according to the embodiment of the present disclosure.

In the charging period SC, SCAN and SCAN3 respectively provide two high-voltage signals, SCAN2 provides a low-voltage signal. The pixel driving circuit operated in this period is in a state shown in FIG. 5B. The data line DL outputs a reference voltage $V_f$. T5 remains to be in conduction state. T4 and T6 are turned off during this period. In this period, the voltage level at the node B increases from 0 to a higher value as T1, T2, and T3 gradually are turned off. Eventually, a voltage difference $V_{cs}$ across two terminals of storage capacitor Cs equals to $3V_{th}$, if it is assumed that each threshold voltage of T1, T2, and T3 is equal to $V_{th}$.

Figure 5C:
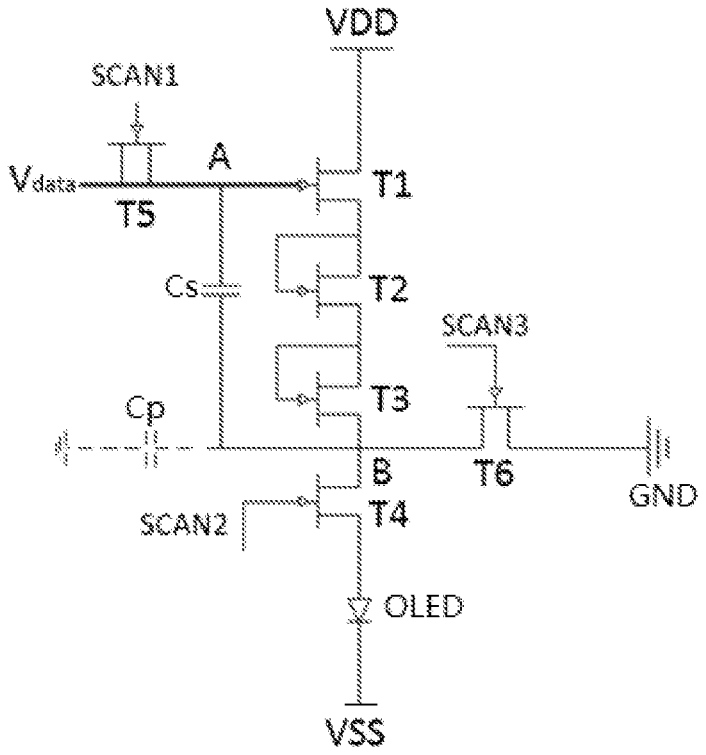
FIG. 5C is a state diagram of operating the pixel driving circuit of FIG. 4A in a data-inputting period according to the embodiment of the present disclosure.

In the data-inputting period SDI, SCAN1 outputs a high-voltage signal, SCAN2 and SCAN3 output low-voltage signals. The pixel driving circuit operated in this period is in a state shown in FIG. 5C. The data line DL now outputs a data voltage $V_{data}$. Since T5 is kept in conduction state, the voltage level at the node A is changed to $V_{data}$. Then, the voltage difference $V_{cs}$ across two terminals of storage capacitor Cs becomes $3V_{th}+\alpha(V_{data}-V_{ref})$, where a equals to C2/(C1+C2) and C1 is a capacitance value of capacitor Cs and C2 is a capacitance value of parasitic capacitor Cp associated with the node B. At the end of the data-inputting period SDI, SCAN1 is changed to provide a low-voltage signal to turn T5 off. This is to prevent the node A from being further charged to change the voltage difference $V_{cs}$ in next period (i.e., emitting period SE). Optionally, the data-inputting period SDI is relatively short so that as long as the voltage difference $V_{cs}$ across two terminals of storage capacitor Cs is changed the next period, emitting period, is started, with the $V_{cs}$ being used for compensating the threshold voltage(s) of the driving transistor(s).

Figure 5D:
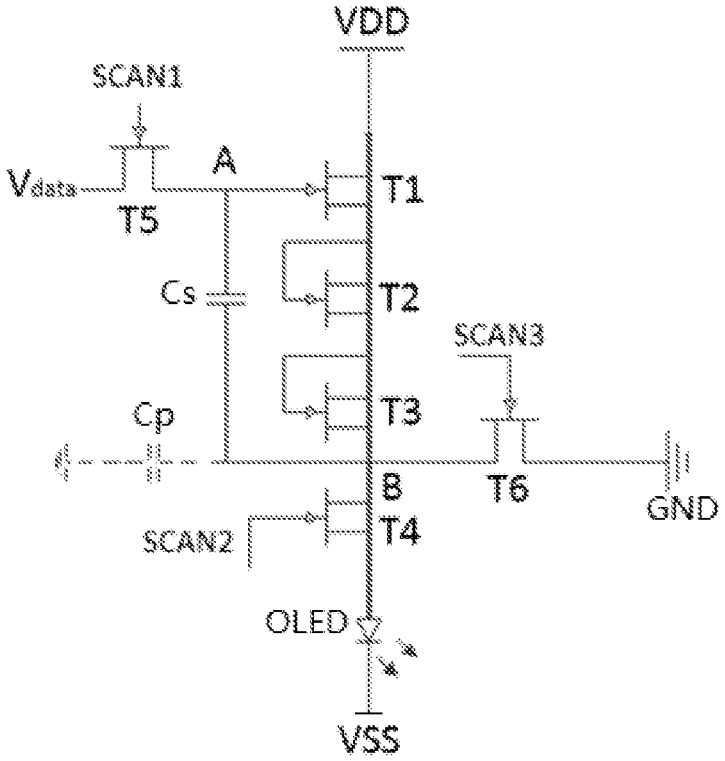
FIG. 5D is a state diagram of operating the pixel driving circuit of FIG. 4A in an emitting period according to the embodiment of the present disclosure.

In the emitting period SE, SCAN1 outputs a low-voltage signal, SCAN2 outputs a high-voltage signal, and SCAN3 outputs a low-voltage signal. The pixel driving circuit operated in this period is in a state shown in FIG. 5D. The data line DL now outputs a data voltage $V_{data}$. Transistors T1, T2, T3, and T4 are all in conduction state while T5 and T6 are turned off T4 in conduction state allows a current flowing through OLED (note no current flows though OLED in previous three periods to enhance image contrast), which can be expressed as:

$$I_{oled} = \frac{W}{L} I_0 \exp\left(\frac{V_{GS,i} - V_{th,i}}{nV_T}\right); \quad (3)$$

$$V_{cs} = 3V_{GS,i} \quad (4)$$

where i can be selected from 1, 2, and 3, referring to the first, second, and third driving transistor. When i=1, $V_{GS,1}$ is a gate-source voltage of the first driving transistor T1, and $V_{th,1}$, is a threshold voltage of T1. When i=2, $V_{GS,2}$ is a gate-source voltage of T2, and $V_{th,2}$ is a threshold voltage of T2. When i=3, $V_{GS,3}$ is a gate-source voltage of T3, and $V_{th,3}$ is a threshold voltage of T3.

Under an assumption that $V_{th,1}=V_{th,2}=V_{th,3}=V_{th}$, and $V_{cs}=3V_{th}+\alpha(V_{data}-V_{ref})$, $V_{GS,1}-V_{th,i}=\frac{1}{3}V_{cs}-V_{th}=\frac{1}{3}\{3V_{th}+\alpha(V_{data}-V_{ref})\}-V_{th}=\frac{1}{3}\alpha(V_{data}-V_{ref})$. As the result, the formula (3) can be modified to the formula (2) shown above Comparing to the current for conventional 2T1C pixel driving circuit, there is no threshold voltage term in the formula (2), thereby reducing sensitivity of the OLED current to the threshold voltage of the driving transistor. Accordingly, the current disclosure diminishes a requirement for manufacturing uniform driving transistors, resulting in cost-saving in manufacture and image quality improvement at the same time.

In formula (2), the coefficient of $V_{data}$ becomes $\alpha/3$ which is enlarged by $3/\alpha$ (>3) over the conventional one. Therefore, for a same current range of $I_{oled}$, the inputted data voltage $V_{data}$ can have an enlarged adjustment range for providing more accurate compensation to obtain more uniform driving current for improved display quality.

In another aspect, the present disclosure also provides a pixel driving method which is implemented through the pixel driving circuit described herein. The method is to drive the pixel driving method within each cycle time for displaying one frame of image. The cycle time includes at least a charging period, a data-inputting period, and an emitting period. In the charging period, the method includes providing a reference voltage to the data line. Additionally, the method includes writing the reference voltage from the data line to the gate electrode of the first driving transistor by the charge-input sub-circuit under control of the first control signal from the first scan line, thereby making the N driving transistors connected in series in conduction state. Furthermore, the method includes charging the power-storage sub-circuit. Moreover, the method includes pulling up a voltage level at the drain electrode of the capacitor in the power-storage sub-circuit until the N driving transistors are turned off by the first control signal. Here N is an integer greater than 1. Optionally, N is at least 2. Optionally, N=3.

In the data-inputting period, the method includes providing a data voltage to the data line. Additionally, the method includes writing the data voltage from the data line to the gate electrode of the first driving transistor by the charge-input sub-circuit under control of the first control signal from the first scan line. Furthermore, the method includes changing a voltage level at the second electrode of the capacitor in the power-storage sub-circuit by coupling a change from the reference voltage to the data voltage at the first electrode of the capacitor.

In the emitting period, the method includes disconnecting the gate electrode of the first driving transistor from the data line by the charge-input sub-circuit under control of the first control signal from the first scan line. Additionally, the method includes passing a driving current through the N driving transistors connected in series to drive emission of a light-emitting diode.

When implementing the method described above, as the driving sub-circuit includes N driving transistors to enlarge the dynamic range of the inputted data voltage for controlling the driving current (for driving light emission) in a same variation range. This facilitates more accurate current control using the pixel driving circuit of the present disclosure.

Additionally, the inputted reference voltage and data voltage are controlled by the charge-input sub-circuit under control of the first control signal from the first scan line. The power-storage sub-circuit provides voltage coupling and charge storing function to achieve compensation to the threshold voltage(s) of the driving transistor(s) in the driving sub-circuit, thereby making the driving current flowing through the light-emitting diode to be independent of the threshold voltage(s).

Furthermore, when the pixel driving circuit includes an emission-control sub-circuit described herein, the emission-control sub-circuit is able to control, in any non-emitting period, disconnection of the source electrode of the N-th driving transistor (the last one in the N driving transistors connected in series) from the light-emitting device, thereby preventing false emission of the light-emitting device and improving display quality.

For implementing the method, all N driving transistors in the driving sub-circuit can be n-type transistors. Accordingly, the data voltage inputted to the circuit should be set to be greater than the reference voltage inputted to the circuit, thereby allowing every driving transistor in the N driving transistors connected in series to be in conduction state. Alternatively, all N driving transistors can be p-type transistors. Accordingly, the data voltage inputted to the circuit should be set to be smaller than the reference voltage inputted to the circuit, thereby allowing every driving transistor in the N driving transistors connected in series to be in conduction state.

When the pixel driving circuit further includes a discharge sub-circuit described herein for control a connection between the source electrode of the N-th driving transistor and a ground port. The method is implemented further in a resetting period before the charging period of each cycle time. Optionally, in the resetting period, the method includes connecting the source electrode of the N-th driving transistor to the discharge port by the discharge sub-circuit under control of the third control signal from the third scan line. Additionally, the method includes providing a reference voltage to the data line. Furthermore, the method includes writing the reference voltage to the gate electrode of the first driving transistor by the charge-input sub-circuit under control of the first control signal from the first scan line, thereby making the N driving transistors connected in series in conduction state and releasing residue charges in the power-storage sub-circuit to the ground port.

Alternatively, in the resetting period, the method includes disconnecting the source electrode of the N-th driving transistor from the light-emitting diode by the emission-control sub-circuit under control of the second control signal from the second scan line. Additionally, the method includes connecting the source electrode of the N-th driving transistor to the discharge port by the discharge sub-circuit under control of the third control signal from the third scan line. Furthermore, the method includes providing a reference voltage to the data line. Moreover, the method includes writing the reference voltage to the gate electrode of the first driving transistor by the charge-input sub-circuit under control of the first control signal from the first scan line, thereby making the N driving transistors connected in series in conduction state, and releasing residue charges in the power-storage sub-circuit to the ground port.

In yet another aspect, the present disclosure provides a pixel circuit including a light-emitting device and a pixel driving circuit described herein. The pixel driving circuit includes multiple (N>1) driving transistors connected in series in which the last transistor (N–th) of the series includes a source electrode coupled to the light-emitting device. Optionally, the light-emitting device is an organic light-emitting diode.

In still another aspect, the present disclosure provides a display apparatus including the pixel circuit described above. The display apparatus can be one of OLED display panel, a smart phone, a tablet computer, a television, a displayer, a notebook computer, a digital picture frame, a navigator, and any product or component having a display function.

The foregoing description of the embodiments of the invention has been presented for purposes of illustration and description. It is not intended to be exhaustive or to limit the invention to the precise form or to exemplary embodiments disclosed. Accordingly, the foregoing description should be regarded as illustrative rather than restrictive. Obviously, many modifications and variations will be apparent to practitioners skilled in this art. The embodiments are chosen and described in order to explain the principles of the invention and its best mode practical application, thereby to enable persons skilled in the art to understand the invention for various embodiments and with various modifications as are suited to the particular use or implementation contemplated. It is intended that the scope of the invention be defined by the claims appended hereto and their equivalents in which all terms are meant in their broadest reasonable sense unless otherwise indicated. Therefore, the term "the invention", "the present invention" or the like does not necessarily limit the claim scope to a specific embodiment, and the reference to exemplary embodiments of the invention does not imply a limitation on the invention, and no such limitation is to be inferred. The invention is limited only by the spirit and scope of the appended claims. Moreover, these claims may refer to use "first", "second", etc. following with noun or element. Such terms should be understood as a nomenclature and should not be construed as giving the limitation on the number of the elements modified by such nomenclature unless specific number has been given. Any advantages and benefits described may not apply to all embodiments of the invention. It should be appreciated that variations may be made in the embodiments described by persons skilled in the art without departing from the scope of the present invention as defined by the following claims. Moreover, no element and component in the present disclosure is intended to be dedicated to the public regardless of whether the element or component is explicitly recited in the following claims.

What is claimed is:

1. A pixel driving circuit, the pixel driving circuit comprising:

a driving sub-circuit comprising N driving transistors connected in series, N being an integer greater than 1, wherein the N driving transistors include a first driving transistor having a drain electrode coupled to a power-supply port and an N-th driving transistor having a source electrode coupled to a light-emitting diode;

a power-storage sub-circuit coupled to a gate electrode of the first driving transistor and the source electrode of the N-th driving transistor; and a charge-input sub-circuit configured to have the gate electrode of the first driving transistor to receive a data voltage under control of a first control signal at a turn-on voltage level.

2. The pixel driving circuit of claim 1, wherein the N driving transistors connected in series comprises an n-th driving transistor and an (n+1)-th driving transistor connected in series; and a source electrode of the n-th driving transistor is coupled to both a gate electrode and a drain electrode of the (n+1)-th driving transistor, wherein n is a positive integer and (n+1) is smaller than or equal to N, the first control signal is supplied from a first scan line and the data voltage is supplied from a data line.

3. The pixel driving circuit of claim 2, wherein the N driving transistors are a same type, wherein N=3, and n≤2.

4. The pixel driving circuit of claim 2, wherein the charge-input sub-circuit comprises a charge-input transistor having a gate electrode coupled to the first scan line, a drain electrode coupled to the data line, and a source electrode coupled to the gate electrode of the first driving transistor.

5. The pixel driving circuit of claim 1, further comprising:

an emission-control sub-circuit configured to connect the source electrode of the N-th driving transistor to the light-emitting diode under control of a second control signal at a turn-on voltage level from a second scan line or to disconnect the source electrode of the N-th driving transistor from the light-emitting diode under control of a second control signal at a turn-off voltage level from a second scan line.

6. The pixel driving circuit of claim 5, wherein the emission-control sub-circuit comprises an emission-control transistor including a gate electrode coupled to the second scan line, a drain electrode coupled to the source electrode of the N-th driving transistor, and a source electrode coupled to light-emitting diode.

7. The pixel driving circuit of claim 1 wherein a difference between threshold voltages of any two driving transistors in the N driving transistors has an absolute value substantially the same.

8. The pixel driving circuit of claim 1, wherein the power-storage sub-circuit comprises a capacitor having a first electrode coupled to the gate electrode of the first driving transistor and a second electrode coupled to the source electrode of the N-th driving transistor.

9. The pixel driving circuit of claim 1, further comprising:

a discharge sub-circuit configured to connect the source electrode of the N-th driving transistor to a ground port under control of a third control signal from a third scan line.

10. The pixel driving circuit of claim 9, wherein the discharge sub-circuit comprises a discharge transistor having a gate electrode coupled to the third scan line, a drain electrode coupled to the source electrode of the N-th driving transistor, and a source electrode coupled to the ground port.

11. A method of driving a pixel driving circuit in a cycle time for displaying one frame of image, wherein the cycle time comprises sequentially a charging period, a data-inputting period, and an emitting period, the pixel driving circuit comprising:

a driving sub-circuit comprising N driving transistors connected in series, N being an integer greater than 1, wherein the N driving transistors include a first driving transistor having a drain electrode coupled to a power-supply port and an N-th driving transistor having a source electrode coupled to a light-emitting diode;

a power-storage sub-circuit coupled to a gate electrode of the first driving transistor and the source electrode of the N-th driving transistor; and a charge-input sub-circuit configured to have the gate electrode of the first driving transistor to receive a data voltage under control of a first control signal at a turn-on voltage level;

the method comprising:

in the charging period, writing a reference voltage from a data line to the gate electrode of the first driving transistor by the charge-input sub-circuit under control of the first control signal at a turn-on voltage level from a first scan line, thereby making the N driving transistors connected in series in conduction state;

charging the power-storage sub-circuit; and pulling up a voltage level at a first electrode of a capacitor in the power-storage sub-circuit until the N driving transistors are turned off;

in the data-inputting period, providing a data voltage to the data line;

writing the data voltage from the data line to the gate electrode of the first driving transistor by the charge-input sub-circuit under control of the first control signal from the first scan line;

changing a voltage level at a second electrode of the capacitor in the power-storage sub-circuit by coupling a change from the reference voltage to the data voltage at the first electrode of the capacitor; and in the emitting period, disconnecting the gate electrode of the first driving transistor from the data line by the charge-input sub-circuit under control of the first control signal from the first scan line; and passing a driving current through the N driving transistors connected in series to drive emission of a light-emitting diode;

wherein N is an integer greater than 1.

12. The method of claim 11, wherein the pixel driving circuit comprises an emission-control sub-circuit configured to connect the source electrode of the N-th driving transistor to the light-emitting diode, the method further comprising:

disconnecting the source electrode of the N-th driving transistor from the light-emitting diode by the emission-control sub-circuit under control of a second control signal from a second scan line in the charging period;

disconnecting the source electrode of the N-th driving transistor from the light-emitting diode by the emission-control sub-circuit under control of the second control signal from the second scan line in the data-inputting period; and connecting the source electrode of the N-th driving transistor to the light-emitting diode by the emission-control sub-circuit under control of the second control signal from the second scan line in the emitting period.

13. The method of claim 12, wherein the pixel driving circuit further comprises a discharge sub-circuit configured to use a third control signal from a third scan line to control a connection between the source electrode of the N-th driving transistor and a ground port; wherein the cycle time further includes a resetting period before the charging period; the method further comprising, in the resetting period:

disconnecting the source electrode of the N-th driving transistor from the light-emitting diode by the emission-control sub-circuit under control of the second control signal from the second scan line;

connecting the source electrode of the N-th driving transistor to the ground port by the discharge sub-circuit under control of the third control signal from the third scan line;

providing a reference voltage to a data line;

writing the reference voltage to the gate electrode of the first driving transistor by the charge-input sub-circuit under control of the first control signal from the first scan line, thereby making the N driving transistors connected in series in conduction state and releasing residue charges in the power-storage sub-circuit to the ground port.

14. The method of claim 11, wherein each of the N driving transistors is an n-type transistor and the data voltage is set to be greater than the reference voltage.

15. The method of claim 11, wherein each of the N driving transistors is a p-type transistor and the data voltage is set to be smaller than the reference voltage.

16. The method of claim 11, wherein the pixel driving circuit further comprises a discharge sub-circuit configured to use a third control signal from a third scan line to control a connection between the source electrode of the N-th driving transistor and a ground port; wherein the cycle time further includes a resetting period before the charging period; the method further comprising, in the resetting period:

connecting the source electrode of the N-th driving transistor to the ground port by the discharge sub-circuit under control of the third control signal from the third scan line;

providing a reference voltage to the data line;

writing the reference voltage to the gate electrode of the first driving transistor by the charge-input sub-circuit under control of the first control signal from the first scan line, thereby making the N driving transistors connected in series in conduction state, and releasing residue charges in the power-storage sub-circuit to a ground port.

17. The method of claim 16, further comprising disconnecting the source electrode of the N-th driving transistor from the discharge port by the discharge sub-circuit under control of the third control signal from the third scan line in each of the charging period, the data-inputting period, and the emitting period.

18. A pixel circuit comprising a light-emitting device and a pixel driving circuit of claim 1 including a driving sub-circuit having N driving transistors connected in series, wherein a first driving transistor of the N driving transistor is a first transistor in the series and the N-th driving transistor of the N driving transistors is a last transistor in the series, wherein the first driving transistor has a drain electrode coupled to a power-supply port and the N-th driving transistor has a source electrode coupled to the light-emitting device, wherein N is an integer greater than 1.

19. The pixel circuit of claim 18, wherein the N driving transistors connected in series comprise an n-th driving transistor connected to an (n+1)-th driving transistor, wherein a source electrode of the n-th driving transistor is coupled to both a gate electrode and a drain electrode of the (n+1)-th driving transistor, wherein n is a positive integer and (n+1) is smaller than or equal to N.

20. A display apparatus comprising a pixel circuit of claim 18.

* * * * *